US010563371B2

(12) United States Patent
Dabos

(10) Patent No.: US 10,563,371 B2
(45) Date of Patent: Feb. 18, 2020

(54) GABION, NOISE BARRIER WALL COMPRISING SUCH A GABION, AND PROCESS FOR EXECUTING SUCH A GABION

(71) Applicant: Omya International AG, Oftringen (CH)

(72) Inventor: François Dabos, Eup (FR)

(73) Assignee: OMYA INTERNATIONAL AG, Oftringen (CH)

( * ) Notice: Subject to any disclaimer, the term of this patent is extended or adjusted under 35 U.S.C. 154(b) by 0 days.

(21) Appl. No.: 16/072,042

(22) PCT Filed: Mar. 3, 2017

(86) PCT No.: PCT/EP2017/054992
§ 371 (c)(1),
(2) Date: Jul. 23, 2018

(87) PCT Pub. No.: WO2017/149113
PCT Pub. Date: Sep. 8, 2017

(65) Prior Publication Data

US 2019/0032298 A1 Jan. 31, 2019

(30) Foreign Application Priority Data

Mar. 4, 2016 (EP) ..... 16305251

(51) Int. Cl.
*E02D 29/02* (2006.01)
*E01B 19/00* (2006.01)

(52) U.S. Cl.
CPC ..... *E02D 29/0208* (2013.01); *E01B 19/003* (2013.01); *E02D 29/025* (2013.01)

(58) Field of Classification Search
CPC . E02D 29/0208; E02D 29/025; E01B 19/003; E01F 8/025
See application file for complete search history.

(56) References Cited

U.S. PATENT DOCUMENTS 4,483,640 A * 11/1984 Berger ..... E02D 29/0208 210/170.03
2004/0020410 A1 2/2004 Gane et al.
(Continued)

FOREIGN PATENT DOCUMENTS

DE 20 2006 003 050 U1 4/2006
EP 2 264 108 A1 12/2010
(Continued)

OTHER PUBLICATIONS

The International Search Report dated May 30, 2017 from PCT/EP2017/054992.
(Continued)

*Primary Examiner* — Patrick J Maestri
(74) *Attorney, Agent, or Firm* — Heslin Rothenberg Farley & Mesiti P.C.

(57) ABSTRACT

The present invention concerns a gabion (1) comprising:
- a cage (10) basically box-shaped, made up of a bottom (11), two frontal walls (12, 13) and two side walls (14, 15). That bottom, frontal and side walls are all formed from meshes respectively (11.1, 12.1, 13.1, 14.1, 15.1) that are fixed to each other;
- two compartmenting partitions (20, 30), that each connect the side walls to one other within the interior of the cage so that the internal volume (V10) of the cage is divided into:
  - two frontal compartments (C1, C2) that are each filled with a filler material (70) made up of aggregate that cannot pass through the respective meshes of the bottom, the frontal or the side walls, nor through the compartmenting partitions in such a way that it is retained within those frontal compartments, and
  - an intermediate compartment (C3), bounded by the compartmenting partitions and which is able to receive a granular acoustic insulation material (2); and (Continued)

at least one lifting partition (50, 60), that fixedly connects the frontal walls (12, 13) to each other within the cage extending through each of the frontal compartments and the intermediate compartment, which, opposite the bottom (11), is provided with at least one grab handle (51, 61), and which, for the part that is set out in the intermediate compartment, is suited to allowing the acoustic insulation material granules (2) to pass through it in such a way that the acoustic insulation material may spread freely, within the intermediate compartment, on either side of the lifting partition.

20 Claims, 6 Drawing Sheets

(56) References Cited

U.S. PATENT DOCUMENTS

2005/0262794 A1* 12/2005 Derache ..... E01F 7/045
52/612

2009/0202308 A1* 8/2009 Heselden ..... E02D 29/0208
405/273

FOREIGN PATENT DOCUMENTS

| | | | |
|---|---|---|---|
| EP | 2 264 109 | A1 | 12/2010 |
| FR | 2 902 808 | A1 | 12/2007 |
| FR | 3 008 113 | A1 | 1/2015 |
| WO | 00/39222 | A1 | 7/2000 |
| WO | 2004/083316 | A1 | 9/2004 |
| WO | 2005/121257 | A2 | 12/2005 |
| WO | 2009/074492 | A1 | 6/2009 |

OTHER PUBLICATIONS

The Written Opinion of the International Searching Authority dated May 30, 2017 from PCT/EP2017/054992.

* cited by examiner

GABION, NOISE BARRIER WALL COMPRISING SUCH A GABION, AND PROCESS FOR EXECUTING SUCH A GABION

CROSS-REFERENCE TO RELATED APPLICATIONS

This is a U.S. national phase of PCT Application No. PCT/EP2017/054992, filed Mar. 3, 2017, which claims priority to European Application No. 16305251.7, filed Mar. 4, 2016.

The present invention concerns gabions, and a noise barrier wall comprising said gabions. It also concerns the process for making said gabion.

A gabion is an individual building component, which, through stacking and/or juxtaposing several specimens, enables work to be executed especially in the fields of civil engineering, public works and that of construction for private individuals. In its "basic" form, which is the most commonly widespread one, a gabion consists of a box-shaped cage whose bottom, four side walls, and, if appropriate, the lid are made from flat wire mesh pieces fixed respectively to each other, typically using clips, steel wire ties and/or welding. The cage is then filled with crushed stone or, more generally, a similar granular material, whose aggregate is retained within the cage since it cannot pass through the holes in the mesh. Stacked and/or juxtaposed gabion cages are bound together using clips or wire ties.

This invention more specifically concerns the use of gabions in the execution of noise barrier walls, also called acoustic screens, for example along roads or railway lines or in industrial or in private surroundings.

In this context, DE 20 2006 003 050 U1 suggests compartmenting the internal volume of a gabion cage to place in it a layer of sand which increases a gabion's sound-absorption performance, since sand offers better acoustic insulation than crushed stone or similar aggregate materials. In order to do this, two compartmenting partitions are set up within the cage, connecting one of side walls to the opposite one of the cage, so that a central compartment is formed between those two compartmenting partitions. The remainder of the volume is split into two end compartments, either side of the central compartment. Each end compartment is filled with crushed stone or a similar filler material, whilst the central compartment houses a bag filled with sand. DE 20 2006 003 050 U1 does not detail either the way the gabion is assembled, or the way it is handled from its place of assembly up to its final place of use: because of the fact that the bag of sand corresponds to an enclosed pocket weighing several tens of kilos, one can imagine that its positioning in the central compartment of a pre-assembled cage is an extremely delicate operation, with a risk of tearing the bag; or else the cage is assembled on site "around" the pre-positioned bag and the filling of the end compartments is then done when the bag of sand is in place within the cage, with a constant risk that the bag can be torn by the filler material placed in the end compartments. In all cases, once the cage contains the bag of sand and the filler material such as crushed stone, its handling is equally difficult, especially when installing the gabion in its final position, stacked on other gabions and/or juxtaposed with them. This once again features the risk of tearing the bag and losing all or part of the sand, especially during the various kinds of handling required for building a noise barrier wall. Furthermore, at the joint between two stacked and/or juxtaposed gabions, the acoustic insulation is compromised by the residual gaps formed. Those gaps tend to exist between the respective gabion sand bags, if only locally. Despite the swelling that a bag has around its edges, the presence of those swellings further significantly increases the risk of tearing the bag at the location of those swellings during gabion handling.

For its part, FR 2 902 808 A1 suggests making a noise barrier wall by placing two rows of "basic" stacked gabions that are each completely filled with crushed stone, whilst creating a space between those two rows in which a core made of acoustic insulating material is placed. In practice, the acoustic insulation material is concrete poured directly between the two rows of stacked gabions. The advantage of this solution is to obtain an acoustic insulation core that extends continuously all along the noise barrier and to the full height. However, that solution is especially costly and tricky, especially because it doubles the number of gabions and since it takes a long time to execute.

The purpose of the present invention is to provide a gabion that, whilst it enables good acoustic insulation performance to be achieved, is economical, and fast and easy to execute.

For this purpose, the invention concerns a gabion as defined in Claim 1.

The invention also involves a process for executing at least one such gabion, as defined in Claim 10.

Thanks to the invention, a noise barrier wall that offers very good acoustic properties can be quickly and economically built. In fact, a gabion according to the invention, where the frontal compartments are pre-filled with a "heavy" aggregate filling material, can be handled using cranes and lifting, in a rapid and secure way using the grab handle(s) on its partition(s). Furthermore, the lifting partition(s) contribute to the structural stability of the cage both during filling of the frontal compartments, without significantly impacting the ease of that filling, and during transport handling and gabion positioning. In addition, those lifting partition(s) enable the sound insulation aggregate material to pass through and to be poured directly into the intermediate partition in the gabion once it is positioned in its final location, typically within a noise barrier wall. That acoustic insulation material thus spreads by gravity throughout the whole or part of the intermediate partition, including through the lifting partition(s), and beneficially coats the bottom mesh, for the part of the latter that forms the edge of the intermediate compartment, and the respective meshes on the side walls, for the portion of those side walls that border the intermediate compartment. When the gabion is stacked and/or juxtaposed with other gabions that are compliant with the invention, especially when forming a noise barrier wall, the acoustic insulation material can thus form continuous joints along the respective intermediate compartments of the gabions: the result is that the acoustic insulation is achieved in a continuous manner both within each gabion taken individually, and between stacked and/or juxtaposed gabions. Improved stability of the wall also results, because of the fact of the continuous joint between the gabions.

Additional beneficial features of gabions according to the invention are provided in the dependent claims 2 to 9.

The invention also concerns a noise barrier wall, as defined in claim 11. Additional beneficial features of this noise barrier wall are provided in claims 12 to 14.

The invention also concerns the use of at least one gabion, as defined in claim 15.

The invention can be more clearly understood by reading the following description, given solely by way of an example and by reference to the drawings in which:

FIGS. 1 to 6 represent a gabion 1.

As clearly visible in FIGS. 1, 2, 5 and 6, gabion 1 comprises a cage 10 with an overall box shape, both on the inside and on the outside. For convenience, the remainder of the description is turned towards considering that the box shape of the cage 10 is oriented as in the use of gabion 1, that is to say, in such a way that the bottom of that box shape extends horizontally and is turned downwards compared to the remainder of the box shape, whilst the four sides of the box shape extend from that base, vertically upwards.

Figure 2:
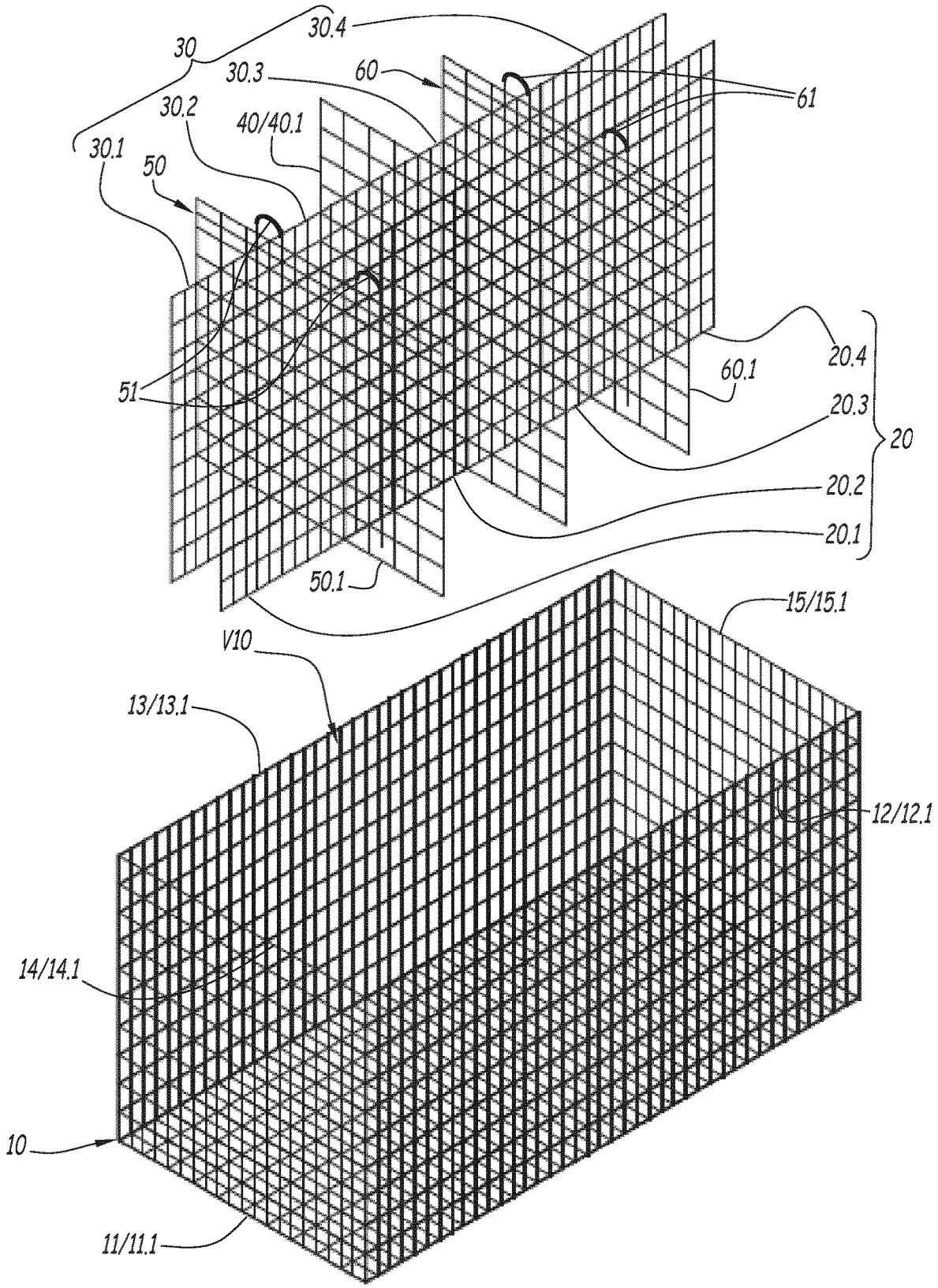
FIG. 2 is a similar view to FIG. 1, showing an exploded view of two groups of gabion components.
Figure 5:
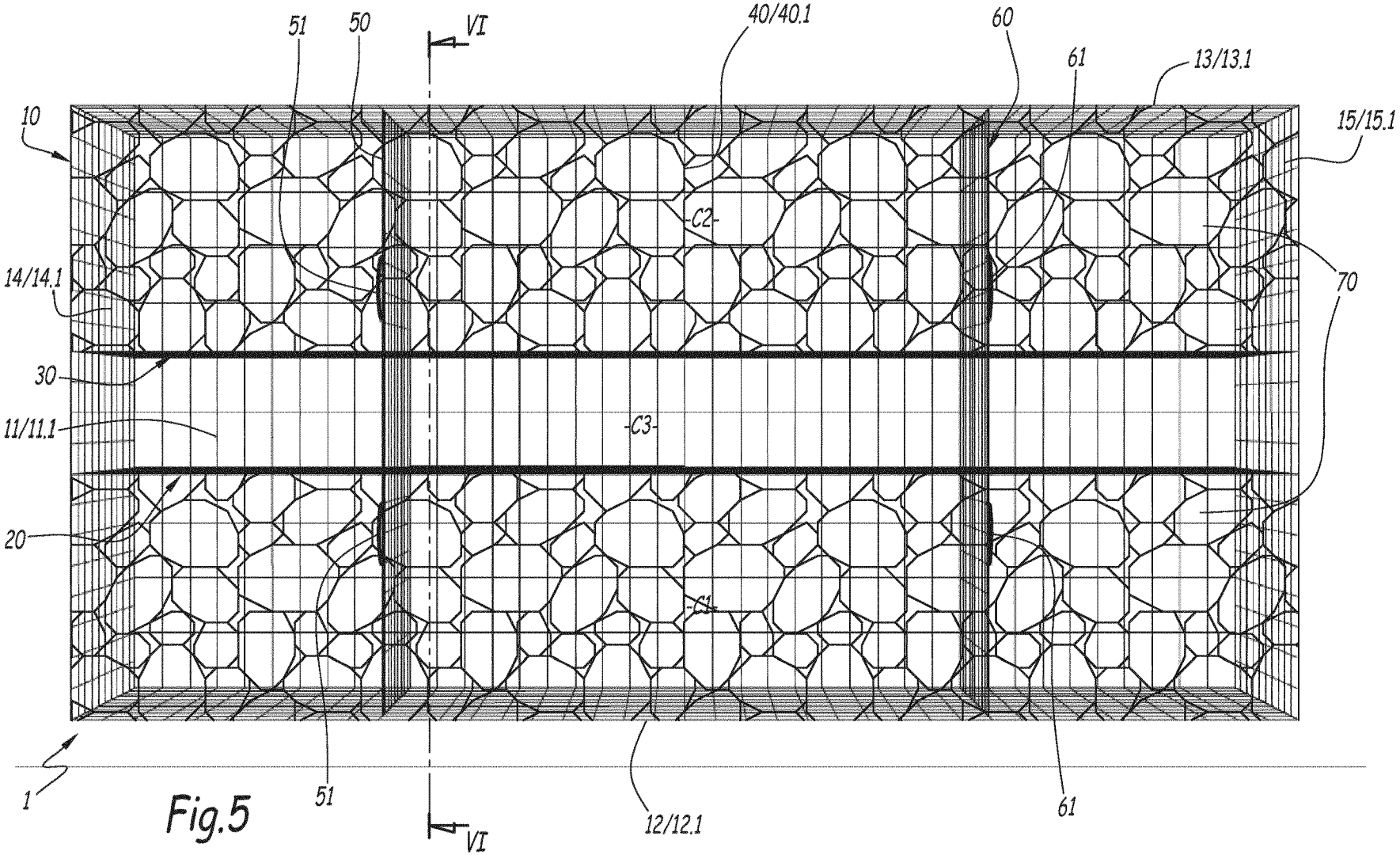
FIG. 5 is an actual perspective view of the gabion from FIG. 1, represented with the filler material drawn in a schematic and transparent manner, as the gabion is observed in accordance with arrow V in FIG. 1.
Figure 6:
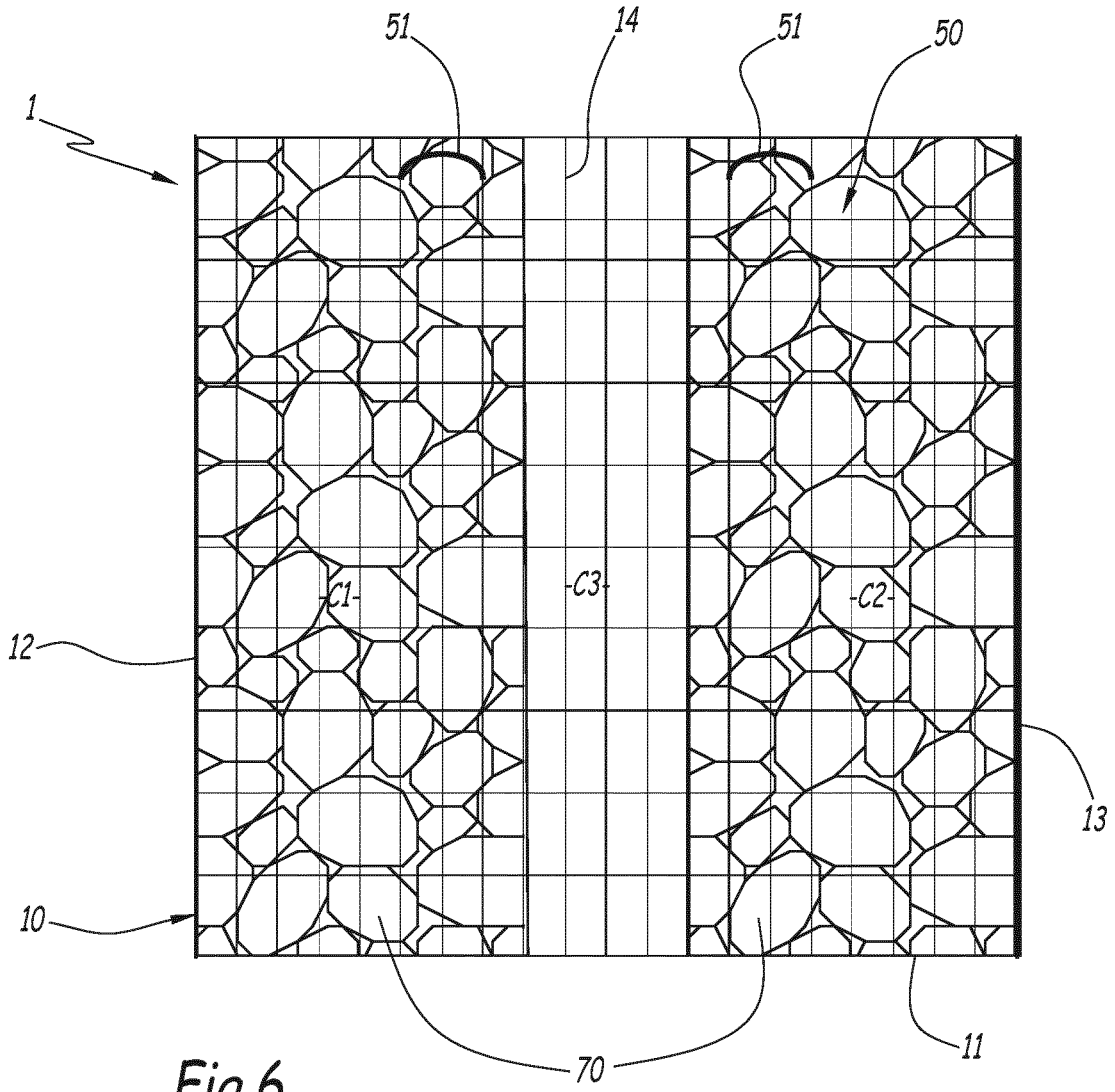
FIG. 6 is a schematic section along the line VI-VI in FIG. 5.

As is clearly visible in FIGS. 2, 5 and 6, the cage 10 includes, at its base, a horizontal bottom 11. That bottom 11 is formed from a flat mesh 11.1, typically made of metal. By way of an example but not by way of limitation, the mesh 11.1 consists of a mat of metal wires, some of which are parallel to each other whilst others extend perpendicularly from the former wires, and these various wires are set out at a distance from each other such that they form an open grid pattern whose meshing, that is to say the openings, have a rectangular or square section. In practice, in a way that is well known in itself, the metal wires referred to above are twisted and/or soldered together to obtain the mesh 11.1. Other forms of execution of the mesh 11.1 can be envisaged as variants that are not shown. In the same way, as an example, the material for the mesh 11.1 is surface galvanised steel, it being understood that other metallic materials or even composites can be envisaged providing they present appropriate mechanical properties for the execution of gabion 1 as presented below. As appropriate, this mesh can be made from several materials, and in particular one material for the core, for example made of metal, in order to give structural resistance to the mesh, and a covering material, made of polymers for example, to protect the core material.

As is clearly visible from FIGS. 1, 2, 5 and 6, the cage 10 comprises two vertical frontal walls 12 and 13 that are located respectively on two of its sides, opposite each other. These frontal walls 12 and 13 extend parallel to each other from the bottom 11. Each of the frontal walls 12 and 13 is formed from a flat mesh 12.1, and 13.1 whose form of execution, without limitation to the invention, is functionally, and even structurally, similar to that of the mesh 11.1 of the bottom 11. Regardless of the form of execution, the meshes 12.1 and 13.1 are fixed to the mesh 11.1 of the bottom 11, by any appropriate means, typically, but not limited to, using clips, wire ties, etc.

Figure 1:
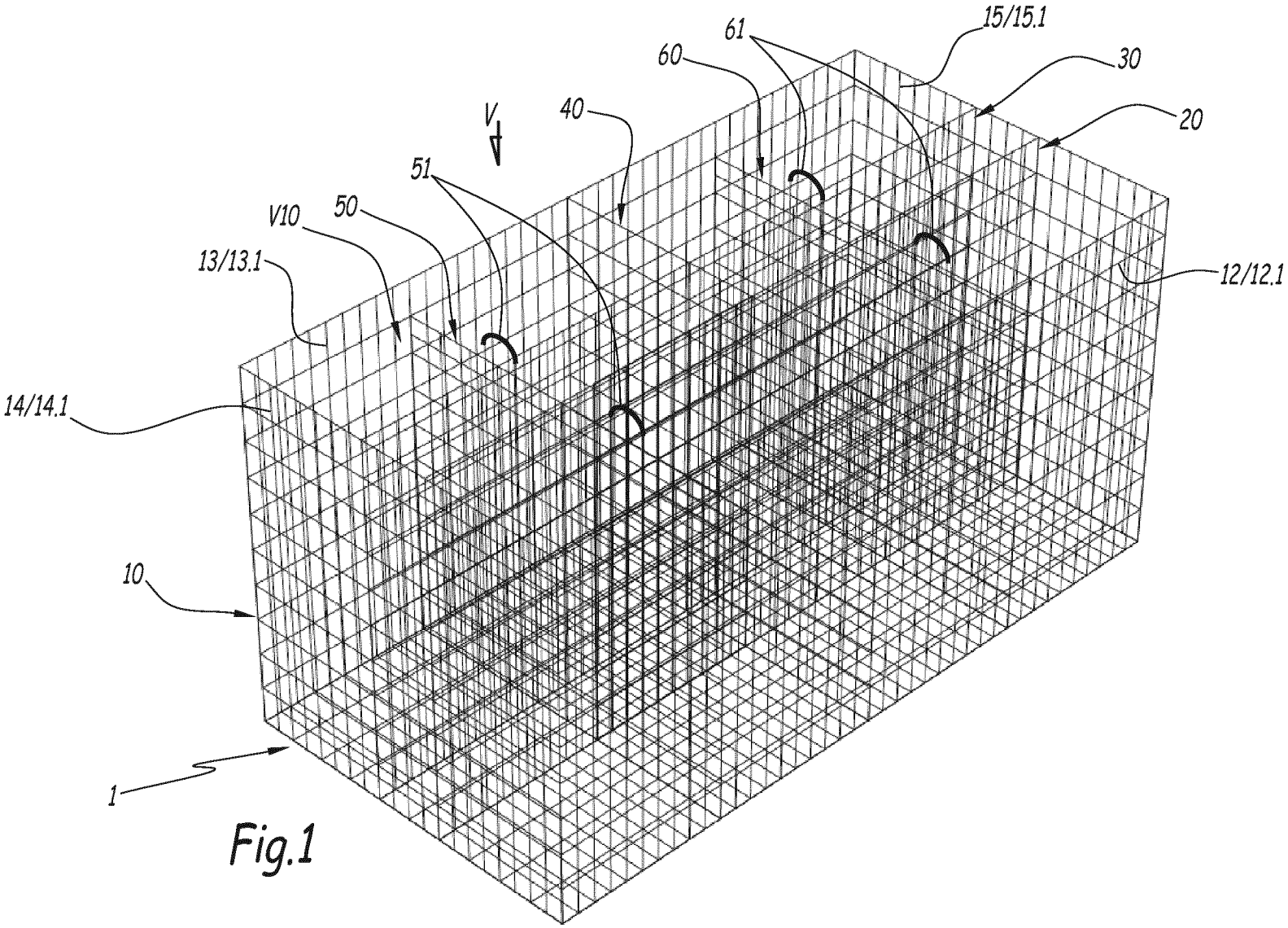
FIG. 1 is an isometric projection of a gabion that is compliant with the invention, whose filling material is not shown for reasons of visibility.

As is also clearly visible from FIGS. 1, 2 and 5, the cage 10 comprises two vertical side walls 14 and 15 that are located on the two opposite sides of the cage, other than those occupied by the frontal walls 12 and 13. The side walls 14 and 15 extend parallel to one another, from the bottom 11. Each of these side walls 14 and 15 is formed of a flat mesh 14.1, and 15.1 whose form of execution, without limitation to the invention, is functionally, and even structurally, similar to that of the meshes 11.1, 12.1 and 13.1. In all cases the meshes 14.1 and 15.1 are fixed both to the mesh 11.1 at the bottom 11 and to the meshes 12.1 and 13.1 of the frontal walls 12 and 13, by any appropriate means, such as those referred to above for fixing meshes 11.1, 12.1 and 13.1.

Given the box shape of the cage 10, the frontal walls 12 and 13 present the same vertical dimensions as the side walls 14 and 15. In the execution example considered in these Figures, the frontal walls 12 and 13 present horizontal dimensions that are greater than those of the side walls 14 and 15, for example roughly double that of walls 14 and 15, it being noted nevertheless that this dimensional aspect is not by way of limitation to the invention. By way of a non limiting dimensional example, the vertical dimension of walls 12 to 15 is between 0.5 m and 2.5 m and the horizontal dimension of walls 12 to 15 is between 0.5 m and 5 m.

The cage 10 presents an internal volume V10, which is bounded by the bottom 11, together with the frontal walls 12 and 13 and the side walls 14 and 15.

The gabion 1 also comprises two compartmenting partitions, with references 20 and 30 respectively, as is clearly visible from FIGS. 1, 2, 5 and 6. These compartmenting partitions 20 and 30 are set out in parallel with each other within the cage 10, that is to say within the internal volume V10 of the latter, extending both vertically and in parallel to the frontal walls 12 and 13. The compartmenting partition 20 is closer to frontal wall 12 whilst compartmenting partition 30 is closer to frontal wall 13. In practice, for reasons that will emerge later on, each of the compartmenting partitions 20 and 30 extends vertically from the bottom 11 of the cage 10, without its lower edge necessarily forming a joint with the bottom 11 and the level of the upper edge of the frontal walls 12 and 13 and side walls 14 and 15, without its upper edge necessarily touching the upper edge of those frontal and side walls. More precise features of the compartmenting partitions 20 and 30 shall be given later.

Regardless of its form of execution, each of the compartmenting partitions 20 and 30 extends from the side wall 14 to the side wall 15 in cage 10, fixedly binding each of those side walls 14 and 15. The internal volume V10 of cage 10 is thus split into three separate compartments, that is two frontal compartments C1 and C2 and an intermediate compartment C3.

As is clearly visible from FIGS. 5 and 6, intermediate compartment C3 corresponds to the part of the internal volume V10 of cage 10, bounded by compartmenting partitions 20 and 30. The intermediate compartment C3 corresponds to 50%, or to 40% or less, or to 30% or less, or to 20% or less, or to 10% or less of the internal volume V10 of the cage 10. By way of a dimensional example and not by way of limitation, the intermediate compartment presents a horizontal dimension, that is to say a distance between compartmenting partitions 20 and 30, which can be for example between 10 cm and 50 cm. Frontal compartments C1 and C2 correspond to the remainder of the internal volume V10, and frontal compartment C1 is bounded by compartmenting partition 20 and frontal wall 12 whilst frontal compartment C2 is bounded by compartmenting partition 30 and frontal wall 13. Going downwards, frontal compartments C1 and C2 and the intermediate compartment C3 are bounded by the bottom 11 of the cage 10, and more precisely by the respective parts that correspond to that bottom 11. Laterally, frontal compartments C1 and C2 and the intermediate compartment C3 are bounded, on one side by the side wall 14, and more precisely by the respective parts that correspond to that side wall 14, and, on the opposite side by the side wall 15, and more precisely by the respective parts that correspond to that side wall 15.

Gabion 1 also comprises a vertical diaphragm partition 40. As is clearly visible in FIGS. 1, 2 and 5, a diaphragm partition 40 is installed to the inside volume V10 of the cage 10, parallel to the side walls 14 and 15, and extends from the frontal walls 12 and 13 by making a fixed connection between each of those frontal walls. In the execution example considered in the drawings, the diaphragm partition 40 is located half way between the side walls 14 and 15. As is clearly visible in FIG. 5, the diaphragm partition 40 then extends through frontal compartment C1, through intermediate compartment C3 and through frontal compartment C2, in this way subdividing each of those compartments into two sub-compartments located on either side of the diaphragm partition 40, and more precisely on either side of the latter, placed in the compartment involved. Vertically, the diaphragm partition 40 extends between the bottom 11 of the cage 10, without necessarily having its lower edge forming a joint with the bottom 11, and the level of the upper edge of the frontal walls 12 and 13 and side walls 14 and 15, without its upper edge necessarily touching the upper edge of those frontal and side walls.

In the example considered in the drawings, the diaphragm partition 40 comprises a flat mesh 40.1 whose form of execution, without limiting the invention, is functionally and even structurally, similar to those of the meshes 11.1, 12.1, 13.1, 14.1 and 15.1. The mesh 40.1 of the diaphragm partition 40 is solidly fixed to the mesh 12.1 and 13.1 on the frontal walls 12 and 13, and to the mesh 11.1 of the bottom 11 as appropriate, using any suitable means, such as with clips or wire ties, as referred to above.

In addition, gabion 1 comprises two vertical lifting partitions 50 and 60. As is clearly visible from FIGS. 2 and 5, each of the lifting partitions 50 and 60 is placed within the internal volume V10 of cage 10, parallel to side walls 14 and 15, and extends from frontal wall 12 to frontal wall 13 thus binding each of these frontal walls to each other solidly. In the example considered in the drawings, lifting partitions 50 and 60 are located on either side of the diaphragm partition 40. Lifting partition 50 is located half way from the diaphragm partition 40 and side wall 14 whilst lifting partition 60 is located half way along from the diaphragm partition 40 and side wall 15.

Figure 3:
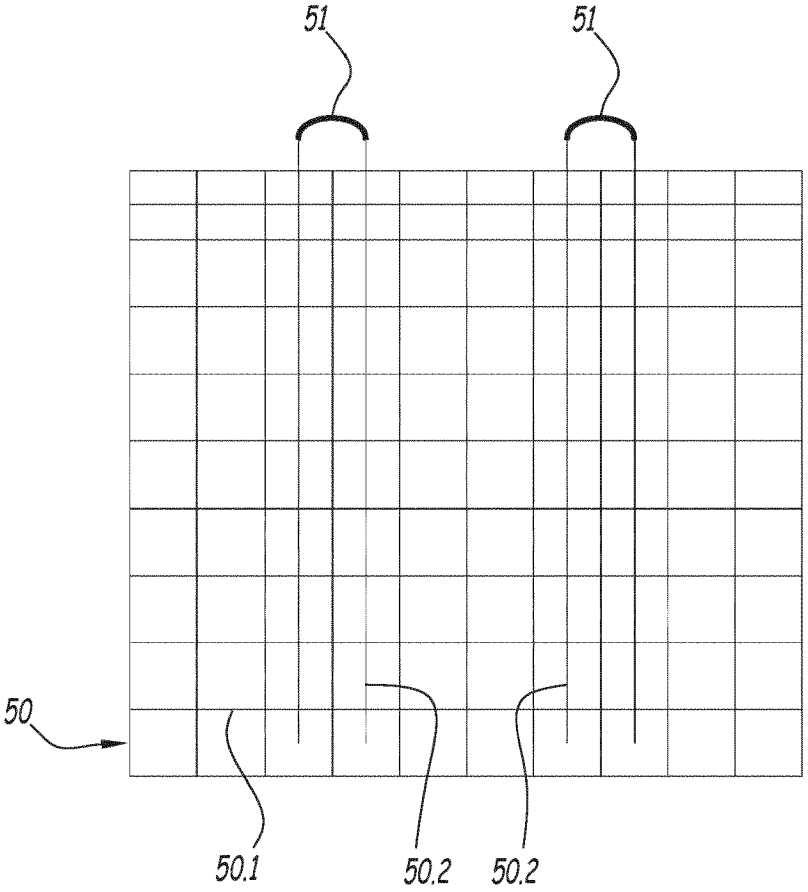
FIG. 3 is an elevation view of a component, shown on its own, of the gabion in FIG. 1.

Vertically, each of the lifting partitions 50 and 60 extends from the bottom 11 of the cage 10. The lower edge of each lifting partition is preferably, but not necessarily contiguous to the bottom 11, to the upper edge of frontal walls 12 and 13 side walls 14 and 15, and the upper edge of each of the lifting partitions 50 and 60 comprises two grab handles 51 and 61 respectively, that adjoin or which are slightly set back from the upper edge of the frontal and side walls. In the execution example considered in the diagrams, the handles 51 and 61 are evenly spread across the upper edge of the lifting partition 50 and 60 respectively, as is clearly visible for the two handles 51 on the lifting partition 50 that is shown on its own in FIG. 3. It may be noted that in the diagrams, the handles 51 and 61 are drawn further apart than they really are purely for the purpose of visibility.

As is clearly visible from FIGS. 1 and 5, each of the lifting partitions 50 and 60 extends, from frontal wall 12 to frontal wall 13, and then across frontal compartment C1, across intermediate compartment C3 and across frontal compartment C2. In this way, the part of the lifting partition 50 and the part of the lifting partition 60 that are set into frontal compartment C1, respectively subdivide the two sub-compartments of frontal compartment C1, bounded on either side by the diaphragm partition 40. The same applies to the respective portions of the lifting partitions 50 and 60, set into frontal compartment C2. In the same way, the portion of the lifting partition 50 and the portion of the lifting partition 60, set into the intermediate compartment C3, respectively subdivide the two sub-compartments of the intermediate compartment C3, bounded on either side by the diaphragm partition 40.

In the execution example considered in the figures, each of the lifting partitions 50 and 60 is formed from flat mesh 50.1, and 60.1 respectively, whose form of execution, without limiting the invention, is functionally and even structurally, similar to those of the meshes 11.1, 12.1, 13.1, 14.1, 15.1 and 40.1. In this way, as is clearly visible in FIG. 3 for lifting partition 50, the mesh 50.1 for that partition is formed from a metal wire mesh, some of which is parallel to each other whilst others are parallel to each other and extend perpendicularly from the former wires, in such a way that the various wires in the mesh 50.1 jointly form an open mesh grid with a rectangular or square section. As is also clearly visible from FIG. 3, that mesh 50.1 in the lifting partition 50 is completed by two wires 50.2, which are formed into a "U" facing downwards and whose rounded base is set on the upper edge of the lifting partition 50, respectively forming the two grab handles 51. Each of those wires 50.2 is fixed solidly to the mesh 50.1 by any appropriate means, typically by using interlocking and/or welding. The mesh 60.1 on the lifting partition 60 presents a similar structure to what has just been described for the mesh 50.1 on lifting partition 50. In both cases, the grab handles 51 and 61 are firmly built into the mesh 50.1, and 60.1 respectively, from their corresponding lifting partition 50, and 60 respectively, whilst respectively forming the hoisting and pulling points for those lifting partitions, which are built into the upper edge of those lifting partitions and which are located virtually at the same level as the upper geometric plane of the cage 10; in particular they do not emerge significantly above that geometric plane.

At the level of their edges that abut frontal walls 12 and 13 respectively, the meshes 50.1, and 60.1 of each of the lifting partitions 50 and 60 are fixed to the meshes 12.1 and 13.1 of the frontal walls 12 and 13, using any appropriate means such as those referred to above. As necessary, the lower edge of each mesh 50.1 and 60.1 may be fixed to the mesh 11.1 of the base 11.

Figure 4:
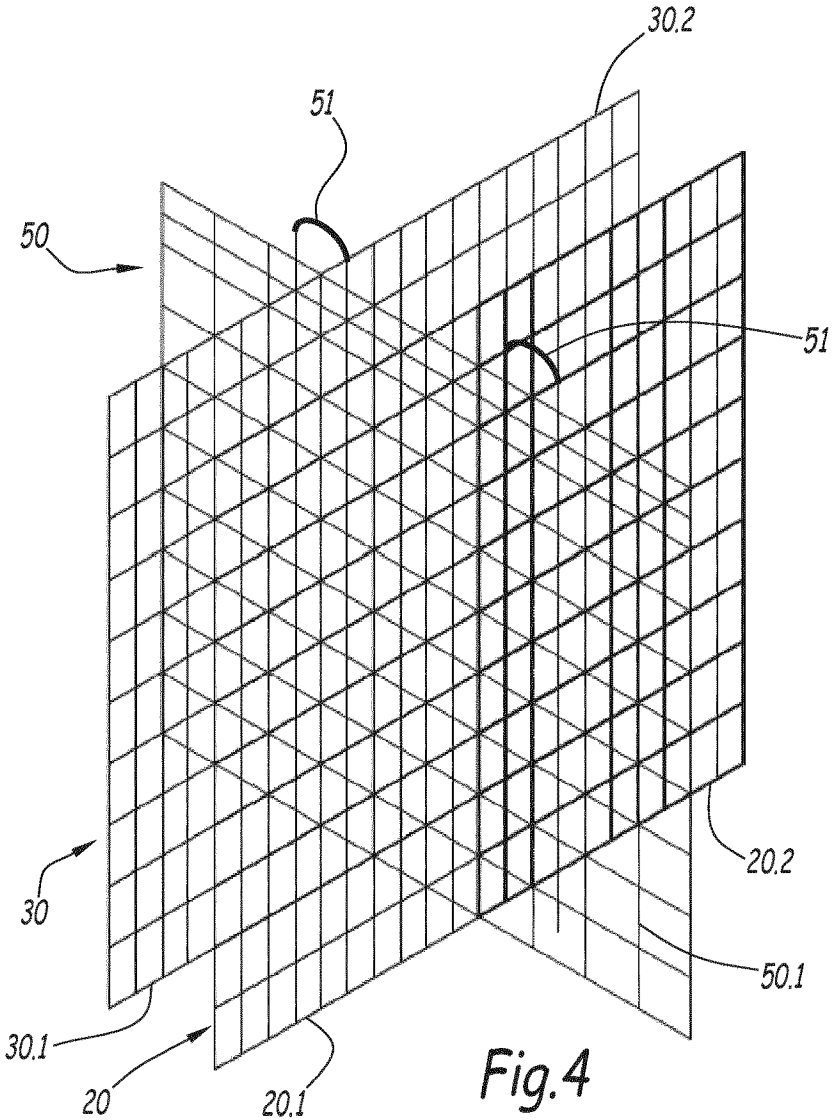
FIG. 4 is an isometric projection of a group of gabion components, including the one shown in FIG. 3.

In order to execute the crossing of each of the lifting partitions 50 and 60 and the two compartmenting partitions 20 and 30, the solution that is executed in the diagrams and which is clearly visible for lifting partition 50 in FIG. 4, consists of each of those compartmenting partitions 20 and 30 comprising two flat meshes 20.1 and 20.2, and 30.1 and 30.2 respectively. Meshes 20.1 and 20.2 in the compartmenting partition 20 are fixed to the mesh 50.1 on the lifting partition 50, on either side of that lifting partition, and meshes 30.1 and 30.2 in the compartmenting partition 30 are fixed to the mesh 50.1 in lifting partition 50, on either side of the latter. The fixings between the meshes referred to above are made using any appropriate means such as those referred to previously. Compartmenting partitions 20 and 30 each comprise in addition two flat meshes 20.3 and 20.4, and 30.3 and 30.4 respectively, that are fixed to the mesh 60.1 on lifting partition 60, on either side of the latter, as is clearly visible in FIGS. 1 and 5. As regards their edge abutting side wall 14, mesh 20.1 of the compartmenting partition 20 and mesh 30.1 of the compartmenting partition 30 are fixed to the mesh 14.1 on the side wall 14. The same applies to meshes 20.4 and 30.4 with the side wall 15 as regards the edges of those meshes abutting the side wall 15. As regards meshes 20.2 and 30.2, their edge opposite the lifting partition 50, is fixed to the diaphragm partition 40. In the same way, the edge of meshes 20.3 and 30.3, opposite lifting partition 60, is fixed to the diaphragm partition 40. As necessary, the lower edge of meshes 20.1, 20.2, 20.3 and 20.4 of the compartmenting partition 20 and the lower edge of meshes 30.1, 30.2, 30.3 and 30.4 of the compartmenting partition 30 are fixed to the mesh 11.1 on the bottom 11. In practice, the form of execution of the meshes 20.1, 20.2, 20.3, 20.4, 30.1, 30.2, 30.3 and 30.4 is functionally and even structurally, similar to those of meshes 11.1, 12.1, 13.1, 14.1, 15.1, 40.1, 50.1 and 60.1.

Gabion 1 also comprises aggregate filler material 70 which, as shown in FIGS. 5 and 6, fills the frontal compartments C1 and C2, it being noted that in those FIGS. 5 and 6, that filler material 70 is represented in a partially transparent manner so that the remainder of gabion 1 can be seen through that filler material, whilst in FIGS. 1 and 2, the filler material 70 is not shown for even more clarity. The filler material 70 is retained within the frontal compartments C1 and C2 by the fact that the aggregate in that filler material 70 presents an aggregate grain size such that they cannot pass through the bottom 11, the frontal walls 12 and 13, the side walls 14 and 15 the compartmenting partitions 20 and 30. In practice the aggregate granule size of the filler material 70 is such that none of the aggregate granules can pass through any of the meshes 11.1, 12.1, 13.1, 14.1, 15.1, 20.1, 20.2, 20.3, 20.4, 30.1, 30.2, 30.3 and 30.4.

According to one embodiment, the filler material 70 is crushed stone, in the widest sense of the expression, that is to say comprising both stone, pebbles and rocks in their natural fragmented state, and stone blocks crushed by human action. Accordingly, other forms of execution can be envisaged for filler material 70 provided that the aggregate size for the latter is retained within the frontal compartments C1 and C2, whilst giving the gabion 1 a substantial mass, which is a value several times greater than the remainder of gabion 1. As an example but not by way of limitation, the filler material 70 may comprise in this way:

- building site rubble,
- clinker,
- crushed glass,
- pieces of timber, of plastic materials, of composites, of marble, chalk, limestone, dolomite or barium,
- natural calcium carbonate or precipitated calcium carbonate, that has undergone a surface reaction with carbon dioxide and one or more acids, the carbon dioxide being formed in situ by the action of the acids and/or coming from an outside source, and
- a combination of the above. Natural calcium carbonate is preferably selected from calcium carbonate that contains calcium mineral salts selected from the group that contains marble, chalk, dolomite, limestone and mixtures of the same. Natural calcium carbonate may also comprise components of a natural origin such as magnesium carbonate, aluminium silicate, etc.

Calcium carbonate precipitate is a synthetic material, generally obtained by precipitation after a reaction between carbon dioxide and calcium hydroxide in an aqueous medium or by precipitation between calcium and a source of carbonate ions in water or by precipitation between calcium and carbonate ions, such as for example CaCl2) and Na2 CO3, out of solution. Other options for producing calcium carbonate are known, such as a process in which the calcium carbonate precipitate is a by-product of producing ammonia. Calcium carbonate precipitate exists in three primary crystalline forms: calcite, aragonite and vaterite, and several different polymorphous forms exist for each of these crystalline forms. A suspension of calcium carbonate precipitate obtained may be dehydrated and dried mechanically.

Natural calcium carbonate or the precipitate may be crushed before being treated with carbon dioxide and the acids.

Other details regarding the preparation of natural calcium carbonate with surface reaction are described in WO 00/39222 A1, WO 2004/083316 A1, WO 2005/121257 A2, WO 2009/074492 A1, EP 2 264 108 A1, EP 2 264 109 A1 and US 2004/0020410 A1, to which a reader can refer.

In the same way, as explained in detail in WO 2009/074492 A1, calcium carbonate precipitate that has had surface reaction is obtained by putting calcium carbonate precipitate in contact with H3O+ ions and anions dissolved in an aqueous environment capable of forming calcium salts that are insoluble in water, so as to form a suspension of calcium carbonate precipitate that has had a surface reaction. In this way the calcium carbonate precipitate with surface reaction comprises a salt that is insoluble by those anions, that is at least partly crystalline, formed on the surface by at least a part of the precipitate of calcium carbonate.

As a variant, silicate and/or silica and/or aluminium hydroxide and/or alkaline earth aluminate and/or magnesium oxide components may be added to the suspension of natural calcium carbonate or precipitate in water once the reaction of the natural calcium carbonate or precipitate with the acids and the carbon dioxide has already started. Further details concerning such a preparation of natural calcium carbonate or precipitate after surface reaction are described in WO 2004/083316 A1.

The suspension in water described above may be dried, and the natural calcium carbonate or precipitate that has undergone surface reaction is thus obtained in solid form (that is to say dry or containing residual moisture that is not in fluid form), or in granular form, such as granules or powder.

Gabion 1 presents other features that will be set out below in the context of an example of the use of several gabions 1 with a view to constructing a noise barrier. That use is described in detail below and partly illustrated in FIGS. 7 and 8.

Figure 7:
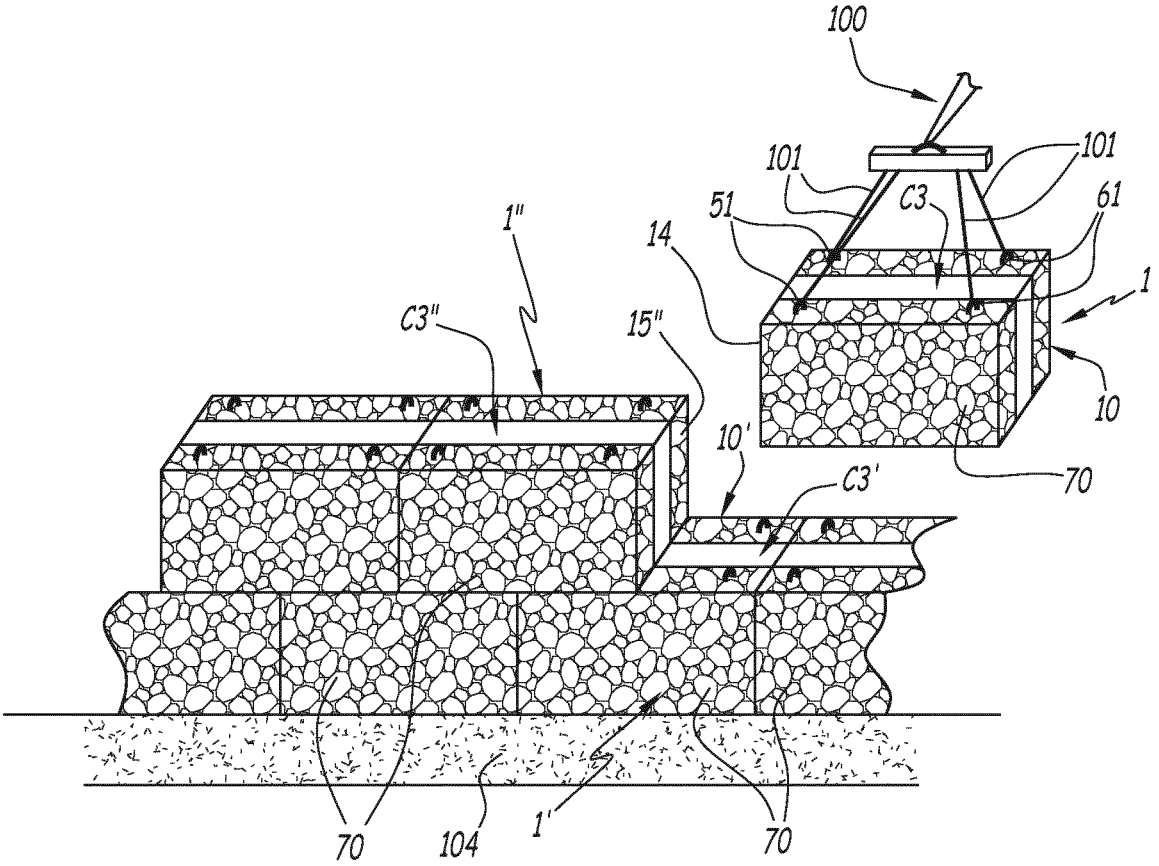
FIGS. 7 and 8 are diagrams illustrating two different steps in executing several examples of the gabion in FIG. 1.

Prior to the step illustrated in FIG. 7, the bottom 11, the frontal walls 12 and 13 and the side walls 14 and 15 of the cage 10, in addition to the compartmenting partitions 20 and 30, the diaphragm partition 40 and the lifting partitions 50 and 70 are assembled and fixed to each other, as set out above, for example using metal clips put in place using a stapling tool. In practice, it is beneficial to execute this assembly operation in the immediate proximity of a stock of filler material 70, for example on the site of a quarry for exacting and producing crushed stone aggregate.

Then, always prior to the step illustrated in FIG. 7, frontal compartments C1 and C2 of gabion 1 are filled with the filler material 70, for example using equipment for loading that aggregate material, taking care that the latter does not get into the inside of intermediate compartment C3. It is beneficial for the filling of the frontal compartments C1 and C2 with the aggregate filling material 70 to be performed under vibration, preferably multi-directionally, applied to gabion 1 in such a manner as to produce vibro-compaction of the aggregate in that material 70 within compartments C1 and C2. In all cases, it should be understood that the diaphragm partition 40 and the lifting partitions 50 and 60 contribute to the structural stability of the gabion 1 during the filling of the frontal compartments C1 and C2, by reinforcing the mechanical resistance of the cage 10 and of the compartmenting partitions 20 and 30 by means of the transmission and sharing of loads between the frontal walls 12 and 13 and, as necessary, the bottom 11.

In practice, filler material 70 is introduced into the frontal compartments C1 and C2, being shared both on either side of the diaphragm partition 40 and on either side of each of the lifting partitions 50 and 60: in other terms, the presence of the diaphragm partition 40 and the lifting partitions 50 and 60 does not impact the ease of filling of the frontal compartments C1 and C2 with the filler material 70.

Still before the step illustrated in FIG. 7, gabion 1 is moved from its initial position, where the frontal compartments C1 and C2 have been filled with the filler material 70, to its final position, where the gabion shall be finally installed. For this purpose, one can use initial lifting gear, such as a mobile crane or similar, whose lifting arm is hooked up to the four grab handles 51 and 61. By lifting the arm of that lifting gear, gabion 1 is lifted, by pulling on the grab handles 51 and 61, from its initial position onto the loading platform of a truck or a similar transport vehicle. The latter shall then transport gabion 1 to the site where the noise barrier wall is being constructed, that site being illustrated in FIGS. 7 and 8. On site, a second item of lifting gear is used to lift gabion 1 from the platform of the transport vehicle, until its final position within the noise barrier being constructed: on FIG. 7, the lifting arm of that second item of lifting equipment bears reference 100 and it is hooked up to the four grab handles 51 and 61 on gabion 1 using four chains 101. Of course, the arm 100 and the chains 101 shown in FIG. 7 are only examples of the equipment that can enable the gabion 1 to be lifted into its final position within the noise barrier.

In practice, one can understand that the location where frontal compartments C1 and C2 are filled with filler material 70, and the construction site of the noise barrier may be several kilometers apart, and in any event at a distance greater than can be covered by static lifting gear, for technical reasons. This therefore requires the use of a vehicle to transport gabion 1 between that location and the work site referred to above.

During the various operations for lifting gabion 1 from its initial position referred to above and its final position within the noise barrier wall, lifting partitions 50 and 60 enable the mechanical loads from lifting and, more generally, of moving the gabion 1, to be transmitted and shared between the frontal walls 12 and 13 and, as necessary, the bottom 11 of cage 10. Those lifting partitions 50 and 60 thus contribute to the structural stability of the cage when handling gabion 1, whilst emphasising that, during those operations, the cage 10 is subjected to a significant load because of the presence of filler material 70 in the frontal compartments C1 and C2. In the same way, without enabling the lifting of gabion 1, the diaphragm partition 40 reinforces the structural stability of the cage 10.

As represented in FIG. 7, gabion 1 comes together with other gabions, similar to gabion 1 within the noise barrier in the course of construction. They were installed prior to the latter in their respective final positions. In particular, gabion 1 is placed, as regards the other gabions already installed in their final positions, in such a way that:

- on the one hand, gabion 1 is superposed on the top of another gabion 1' in such a way that at least part of the intermediate compartment c3 of gabion 1 is positioned vertically above at least part of the intermediate compartment c3' of gabion 1', and
- on the other hand, gabion 1 is juxtaposed to another gabion 1", by abutting its side wall 14 to the side wall 15" of gabion 1", in such a way that the intermediate compartment C3 of gabion 1 is laid horizontally next to the intermediate compartment C3" of gabion 1".

In practice, the alignment, both horizontal and vertical, of gabions 1, 1' and 1" do not have to be strictly precise, providing the respective intermediate compartments C3, C3' and C3" of those gabions are at least partly aligned. In the same way, as in the example shown in FIG. 7, the cages 10 and 10' of the stacked gabions 1 and 1' may be displaced horizontally with regard to one another, in such a way that the side wall 15" of gabion 1" is not vertically above one of the side walls of gabion 1', but between those side walls of gabion 1'.

It will be noted that stacking gabions 1 and 1' is favoured by the fact that the grab handles for gabion 1' do not stick out beyond the upper geometric plane of the cage 10' of that gabion 1', and thus those handles do not interfere with the bottom 11 of the cage 10 of gabion 1.

Figure 8:
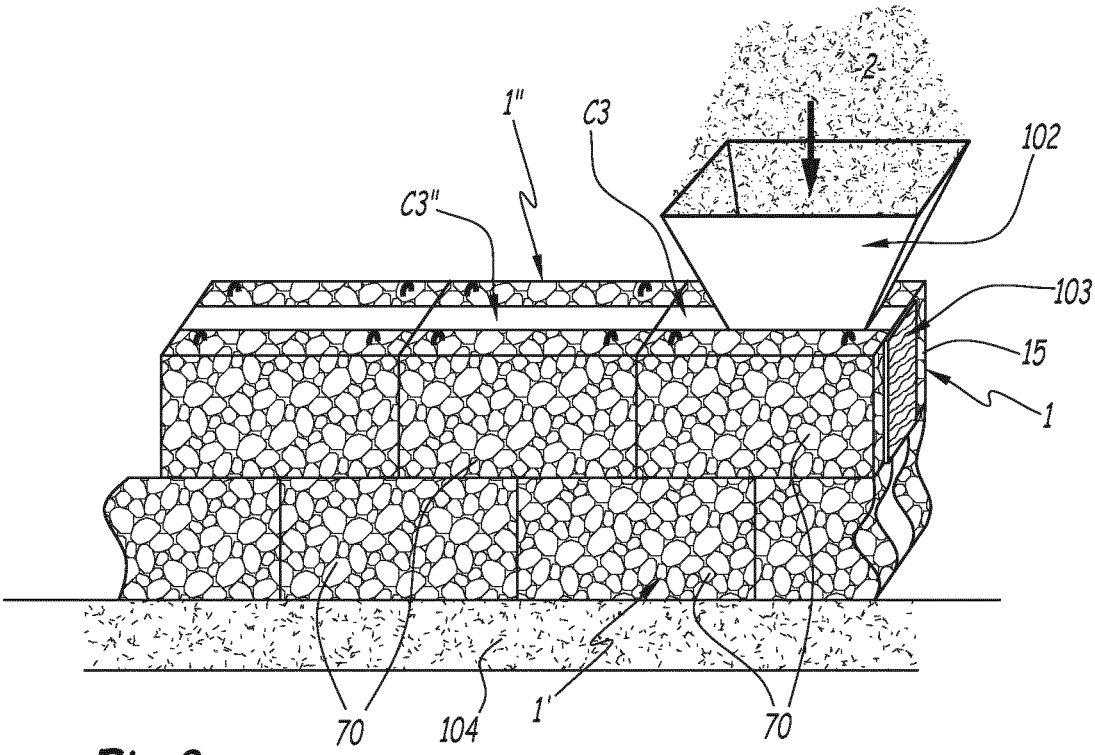

Once gabion 1 has been installed in its final position within the noise barrier wall, it is as shown in FIG. 8. An acoustic insulation material 2 is then poured into the intermediate compartment C3 of gabion 1, through which that acoustic insulation material 2 spreads by the action of gravity. In the same way as for filler material 70, material 2 is a granular aggregate. However, that material 2 can be distinguished from the filler material 70 through the fact that the material 2 presents better acoustic insulation than the material 70. That acoustic insulation performance for material 2, compared with the filler material 70, has to do with certain intrinsic features of the material, and in particular with its density and grain size.

For example, acoustic insulation material 2 is made up from a graded aggregate mix, that is to say a mix of sand and gravel that has a grain size of between 0/14 mm and 0/63 mm. Another example of the acoustic insulating material 2 is concrete, which is poured into the intermediate compartment C3 when freshly mixed, and which then sets and hardens within that compartment C3. This said, other examples can be envisaged for the material 2, such as:

- crushed site rubble,
- crushed mining slag,
- crushed pieces of marble, chalk, limestone, dolomite or barium,
- granules of natural calcium carbonate or calcium carbonate precipitate, that has undergone a surface reaction with carbon dioxide and one or more acids, the carbon dioxide being formed in situ by the action of the acid(s) and/or derived from an outside source, and
- a mixture thereof.

More generally, it will be understood that the acoustic insulation material 2 will comprise smaller grain sizes than those of the filler material 70, and the grain size of this material 2 shall be bound together by a binding agent as necessary, and a hydraulic binding agent in particular, that appertains to that material 2.

In accordance with an important feature of the invention, lifting partitions 50 and 60, and more precisely the part of those partitions laid out in compartment C3 of gabion 1, and the acoustic insulation material 2 are set out in such a way that, when pouring the material 2 into intermediate compartment C3, the grains of that material 2 shall cross through either side of the lifting partitions 50 and 60, spreading freely, within intermediate compartment C3, on either side of each of the lifting partitions 50 and 60. In practice, one can understand that the mesh of the lattices 50.1 and 60.1 respectively of the lifting partitions 50 and 60 are sufficiently large as to enable the aggregate of the acoustic insulation material to pass through. In the same way, this is beneficial for the mesh in latticework 401 of the diaphragm partition 40. Accordingly, within gabion 1, the material 2 is poured into the intermediate compartment C3 and easily spreads into the entire intermediate compartment, comprising through lifting partitions 50 and 60 and the diaphragm partition 40, until that intermediate compartment C3 is filled. Material 2 fills compartment C3 and forms acoustic insulation between compartmenting partitions 20 and 30 and, accordingly, gives acoustic insulation to gabion 1 between frontal walls 12 and 13. The filler material 70 in the frontal compartments C1 and C2 contributes to that acoustic insulation but to a significantly less extent than that contributed by the material 2 in the intermediate compartment C3.

Furthermore, providing that the mesh in the latticework 11.1 of the bottom 11 of gabion 1 will also let pass through acoustic insulation material 2, one can understand that pouring the material 2 into the intermediate compartment C3 of gabion 1 will lead to that material 2 leaking out through the bottom 11 of the cage 10 of this gabion, and more precisely through that part of that bottom 11 that bounds compartment C3, and the insulation material 2 will then join that in intermediate compartment C3' of gabion 1'. In this way the material 2 would also fill intermediate compartment C3' if the latter was not filled by acoustic insulation material 2 prior to gabion 1 being installed over gabion 1'. Naturally, as a variant, filling intermediate compartment C3' of gabion 1' may have been executed between the installation of that gabion 1' and that of gabion 1. In any case, that is to say both in the case where stacked gabions 1 and 1' have their intermediate compartments C3 and C3' that are both filled simultaneously, and in the case where the compartment C3' of gabion 1' is at least partly filled prior to gabion 1 being installed on top of it, one can understand that, by allowing the granules of acoustic insulation material 2 to pass freely through the mesh 11.1 of the bottom 11 of gabion 1, the material 2 seamlessly forms a joint between the intermediate compartment C3 of gabion 1 and with intermediate compartment C3' of gabion 1', and more precisely joins in a seamless manner the bottom of compartment C3 with the top of compartment C3'.

In the same way, by providing that the mesh of the latticework 14.1 and 15.1 of side walls 14 and 15 allow the granules of the material 2 to pass freely through those side walls 14 and 15, material 2 seamlessly joins the intermediate compartment C3 of gabion 1 with the intermediate compartment C3" of gabion 1", by crossing though the side wall 14 of gabion 1 and the side wall 15" of gabion 1" successively, on pouring the insulation material 2 into the intermediate compartment C3 and/or during material 2 being poured into the intermediate compartment C3" of gabion 1".

More generally, taking account of the above explanations, one can understand that, by filling the intermediate compartment C3 with acoustic insulation material 2, that material 2 forms continuous acoustic insulation between the intermediate compartment C3 and the adjacent intermediate compartments C3' and C3", and in this way brings soundproofing to the stacked joints and/or to the abutting joints of the various gabions that form the noise barrier wall.

In practice, as represented in FIG. 8, a spout 102 may be used beneficially above gabion 1 when pouring the acoustic insulation material 2, to channel that pouring within the top of intermediate compartment C3, as the outlet to the bottom of that spout 102 can be adjusted to the outlet at the top of the intermediate compartment C3.

In accordance with an optional beneficial arrangement, which is executed in FIG. 8, the side wall 15 of the gabion 1 is blocked on the outside on part of that side wall 15, thus outlining the intermediate compartment C3. In order to do so, as shown diagrammatically in FIG. 8, a side blocking element 103 for the intermediate compartment C3 is added to the outer face of the side wall 15. In that way, the acoustic insulating material 2 poured into the compartment C3 is retained within the intermediate compartment C3, without pouring outside it, through side wall 15. Of course, one can understand that executing that side blocking element 103 is only worthwhile when the side wall of the gabion, against which that side blocking element is applied, forms at least one part of a section with a free extremity in the noise barrier wall being built. In practice, the form of execution for the side blocking element 103 is not limited, and that form of execution can be adapted furthermore in accordance with the nature of the material 2. In this way, when the acoustic insulation material 2 is made up of sand and gravel, the following can be used regardless: packing material, a tarpaulin or a gabion made under previous techniques, that is to say a gabion whose total internal cage volume is filled with a material similar to the filler material 70. In the case where the acoustic insulation material 2 is concrete, the side blocking element 103 can be a plank for example or, more generally, a piece of formwork.

According to considerations similar to those above concerning the side blocking element 103, it can be noted that, on installation, at the base of the noise barrier wall being built, from the first gabion or the first row of juxtaposed gabions, such as gabion 1', one can envisage blocking the outside face of the bottom 11, at the part of the latter that bounds the intermediate compartment of the lowest gabion(s) within the noise barrier wall. In practice, a foundation 104, such as a slab or something similar, made or excavated prior to installing the first gabions of the noise barrier wall enables, once the acoustic insulation material 2 is then poured into the intermediate compartments of those gabions, that this material 2 can be retained within the intermediate compartments involved, without any risk of leakage or dispersing the product below the noise barrier wall.

It will further be noted that, as regards compartmenting partitions 20 and 30, the acoustic insulating material 2 tends to spread from the intermediate compartment C3 of gabion 1, through the compartmenting partitions 20 and 30. However, in practice, the filler material 70, that is present in the frontal compartments C1 and C2, limits the possibility of leakage of the acoustic insulating material 2 beyond the immediate proximity of the compartmenting partitions 20 and 30. By way of an option, one can envisage preventing the acoustic insulating material 2 from crossing meshes 20.1, 20.2, 20.3, 20.4, 30.1, 30.2, 30.3 and 30.4 of compartmenting partitions 20 and 30 from the intermediate compartment C3, by covering the entire face of each of those meshes, adjoining the intermediate compartment C3, with a sheet of geotextile or with a geo-synthetic barrier.

At the end of the step shown in FIG. 8, that is to say after having filled the respective intermediate compartments of the gabions that form part of the noise barrier wall, and in particular the intermediate compartment C3 of gabion 1, the acoustic insulating material 2 may beneficially be compacted. In order to do so, an immersion vibrator or a rammer is applied to the acoustic insulating material 2, via the upper opening of the intermediate compartments of the uppermost gabions. If necessary, at the end of that compaction, additional acoustic insulating material 2 is poured into the intermediate compartments C3.

Lastly, optionally, the top opening of the intermediate compartments of the topmost gabions in the noise barrier wall is made weather-tight, by any appropriate means added to the top of the noise barrier wall.

Therefore, the noise barrier wall, obtained at the end of the process of execution that has just been described, will be executed in a rapid and easy manner, in particular thanks to lifting partitions 50 and 60, whilst remaining especially high-performing as regards the acoustic insulation of that wall, thanks to the soundproofing using acoustic insulating material 2; and as regards the structural stability of the wall, thanks to the absence of deformation of the cages in the gabions and to the continuous joining by the acoustic insulating material between those cages.

A noise barrier wall built in this way may constitute or form part of civil engineering works, public works, industrial facilities or private construction.

In accordance with an execution variant not pictured for gabions 1, their intermediate compartment C3 may receive, in addition to the granular acoustic insulating material 2, a semi-rigid sheet or a plate or a panel, set vertically within the compartment C3 in such a way as the subdivide the latter into several honeycombs open at the top. It is then possible to fill those honeycombs with various acoustic insulating materials, in particular in order to adjust the performance and cost of the noise barrier wall built.

In accordance with an aspect that could potentially be complementary to the above, gabions 1 can be used to build a firewall. In practice, the fire resistant capacity of the wall is then bound up with the nature of the filler in the intermediate compartments C3 in gabions 1: acoustic insulating material 2 can be chosen in a fire-proof version or be treated for that purpose, so that the wall thus obtained is both a noise barrier and a firewall. A fire-proof material or incombustible material can also be placed in the intermediate compartments C3, that is, as an addition to the acoustic insulating material 2 to obtain a wall that is both a noise barrier and a firewall, or to replace the acoustic insulating material to obtain a firewall.

Tested Sample:

A noise barrier wall was erected by stacking several gabions 1, identical to each other. The meshes 11.1, 12.1, 13.1, 14.1, 15.1, 20.1, 20.2, 20.3, 20.4, 30.1, 30.2, 30.3, 30.4, 40.1, 50.1 and 60.1 used were identical, with a rectangular grid of 5 cm×10 cm. The meshes 11.1, 12.1 and 13.1 measured 200 cm×100 cm, whilst the meshes 14.1 and 15.1 measured 100 cm×100 cm, so that the internal volume V10 of the cage 10 came to 2 $m^3$.

Meshes 50.1 and 60.1 measured 100 cm horizontally, with a height of 90 cm, and the grab handles 51 and 61 extend 10 cm further towards the upper edge of the mesh 50.1 and 60.1.

Each of the meshes 20.1, 20.2, 20.3, 20.4, 30.1, 30.2, 30.3 and 30.4 measured 50 cm horizontally and 100 cm vertically. The compartmenting partitions 20 and 30 were set up with a gap between them of 20 cm.

The mesh 40.1 measured 100 cm×100 cm.

The filler material 70 was crushed stone, with a 80/130 mm grain size.

The acoustic insulation material 2 was sand-gravel aggregate with a grain size of 0/30 mm.

The noise barrier wall was built from twelve gabions, set out in three rows stacked on top of each other, each row being made of four juxtaposed gabions.

Tests of the noise barrier wall, executed in compliance with the French National Standard NF EN 1793-6, confirmed excellent sound proofing, coming into class D4, that is to say the highest class defined in the standard quoted above. That corresponds to aerial noise insulation value (DLSI, G) of about forty decibels.

Similar soundproofing performance was observed with and without the presence of sheets of geotextile in the compartmenting partitions 20 and 30.

Furthermore, the various layouts and variants of gabion 1 considered above and in the noise barrier wall involving several specimens of the gabion 1, and in the process of executing gabions 1, can be envisaged. Here are some examples:

- in addition to the bottom 11, frontal walls 12 and 13 and side walls 14 and 15, the cage 10 of gabion 1 may, as an option, comprise a lid that encloses the internal volume v10 at the top of the cage 10; in practice, that lid will comprise one or more meshes, that will cover at least frontal compartments c1 and c2, in addition to, if required, the intermediate compartment c3. that lid will thus secure the retention of the filler material 70 within frontal compartments c1 and c2, in particular when moving the gabion 1, whilst enabling the acoustic insulation material 2 to pass through it when filling the intermediate compartment c3 with that material 2;
- in particular, in accordance with the dimensions of the cage 10 of gabion 1, the diaphragm partition 40 can be left out or, on the contrary, several diaphragm partitions can be provided; in the same way, a single lifting partition or, on the contrary, more than two lifting partitions can be provided for. In the same spirit, for each lifting partition, one single grab handle or more than two grab handles may be provided for. More generally, the arrangement relating to diaphragms and for lifting can be adapted to the size of gabion 1; and/or
- instead of occupying a central position between the frontal walls 12 and 13, the intermediate compartment C3 may be arranged to be closer to one of the frontal walls.

The invention claimed is:

1. A gabion (1), comprising:

a cage (10) having a box-shape, the cage comprises a bottom (11), located at a base of the cage, two frontal walls (12, 13), that are located on two opposite lateral sides of the cage, and two side walls (14, 15), that are located on two other side walls of the cage, the bottom, the frontal walls and the side walls are formed respectively from meshes (11.1, 12.1, 13.1, 14.1, 15.1) that are fixed one to the other, and two compartmenting partitions (20, 30), which each fixedly connect the side walls to each other inside the cage in such a way that an internal volume (v10) of each cage is split into:

two frontal compartments (C1, C2), which are bounded respectively between one (12) of the frontal walls and one (20) of the two compartmenting partitions that is closest to that frontal wall and between the other frontal wall (13) and the other compartmenting partition (30), and which are each filled with a filler material (70) made up of aggregates that are too large to pass through holes of the meshes of the bottom, the frontal walls and the side walls respectively, nor through the compartmenting partitions, in such a way that it is retained within those frontal compartments, and an intermediate compartment (C3), which is bounded between the compartmenting partitions and which is able to receive granular acoustic insulation material (2), wherein the gabion (1) further comprises at least one lifting partition (50, 60):

fixedly connecting the frontal walls (12, 13) to each other within the cage by extending through each of the frontal compartments (C1, C2) and the intermediate compartment (C3), being opposite the bottom (11), fitted with at least one grab handle (51, 61), and being, for the part laid out in the intermediate compartment, adapted in order to enable the granular acoustic insulation material (2) to pass through it in order that the granular acoustic insulation material may spread freely, within the intermediate compartment (C3), on either side of the lifting partition (50, 60).

2. The gabion of claim 1, wherein the filler material (70) comprises at least one of:

crushed stone, building site rubble, clinker, crushed glass, pieces of timber, of plastics, of composites, marble, chalk, limestone, dolomite or barium, granules of natural calcium carbonate or of precipitated calcium carbonate, that has undergone a surface reaction with carbon dioxide and one or more acids, with the carbon dioxide being formed in situ by the action of the acids and/or derived from an outside source, or a mixture thereof.

3. The gabion of claim 1, wherein the lifting partition (50, 60) comprises:

a flat mesh (50.1, 60.1);

wherein the grab handle(s) are fixed (51, 61) to the flat mesh;

wherein being fixed to the meshes (11.1, 12.1, 13.1) of the bottom (11) and of the frontal walls (12, 13) respectively, and wherein the flat mesh (50.1, 60.1) extends through each of the frontal compartments (C1, C2) and the intermediate compartment (C3); and wherein grains of the granular acoustic insulation material (2) can pass through holes in the flat mesh so as to spread either side of the lifting partition (50, 60).

4. The gabion of claim 3, wherein each compartmenting partition (20, 30) comprises at least two flat meshes (20.1, 20.2, 20.3, 20.4, 30.1, 30.2, 30.3, 30.4), fixed to the mesh (50.1, 60.1) of each lifting partition (50, 60), being laid out respectively on either side of that lifting partition.

5. The gabion of claim 4, wherein each mesh (20.1, 20.2, 20.3, 20.4, 30.1, 30.2, 30.3, 30.4) of each compartmenting partition (20, 30) is fixed to the mesh (11.1) of the bottom (11), and that each of the two meshes (20.1, 20.4, 30.1, 30.4) in each compartmenting partition, which respectively abut the side walls (14, 15), is fixed to the mesh (14.1, 15.1) of the corresponding side wall.

6. The gabion of claim 4, wherein each compartmenting partition (20, 30) also comprises for each of the meshes (20.1, 20.2, 20.3, 20.4, 30.1, 30.2, 30.3, 30.4) in that compartmenting partition, a sheet of geotextile or of geosynthetic material, that covers an entire face of the mesh turned towards the intermediate compartment and that is suited to preventing the acoustic insulation material crossing that mesh from that intermediate compartment (C3).

7. The gabion of claim 1, wherein at least two grab handles (51, 61) are provided for each lifting partition (50, 60), shared across the frontal walls.

8. The gabion of claim 1, wherein at least two lifting partitions (50, 60) are provided, shared across the side walls.

9. The gabion of claim 8, wherein the gabion further comprises a diaphragm partition (40):

fixedly connecting the frontal walls (12, 13) to each other within the cage extending through each of the frontal compartments (C1, C2) and the intermediate compartment (C3), being, for the part that is laid out within the intermediate compartment, suited to let the granular acoustic insulation material (2) pass through it so that the acoustic insulation material may spread freely, within the intermediate compartment (C3), on either side of the diaphragm partition (40), and on either side of which at least two lifting partitions are set out (50, 60).

10. A method of using at least one gabion according to claim 1, wherein the method comprises, for each gabion (1, 1', 1"):

a movement step, during the course of which the gabion is moved from an initial position, where the frontal compartments (C1, C2) of the gabion are filled with the filler material (70), before the movement step, to a final position, where the gabion is definitively permanently installed, the gabion being lifted at least once between its initial position and its final position by hooking up and dragging on its grab handles (51, 61); and a filling step, which is executed after the movement step and during which granular acoustic insulation material (2) is poured into the intermediate compartment (C3, C3', C3") of the gabion in its final position, spreading through the intermediate compartment including through at least one of the lifting partitions (50, 60), until it at least partly fills that intermediate compartment.

11. A noise barrier wall, wherein the noise barrier wall comprises at least one gabion (1, 1', 1") of claim 1, in addition to a granular acoustic insulation material (2) which at least partially fills the intermediate compartment (C3, C3', C3") of each gabion.

12. The noise barrier wall of claim 11, wherein the acoustic insulation material comprises:

a sand and gravel mix, concrete, crushed building site rubble, crushed mining operation waste debris, crushed pieces of marble, chalk, limestone, dolomite or barium, granules of natural calcium carbonate or precipitated calcium carbonate, that has undergone a surface reaction with carbon dioxide and one or more acids, the carbon dioxide being formed in situ by the action of the acid(s) and/or from an outside source, or a mixture thereof.

13. The noise barrier wall of claim 11, wherein it further comprises:

at least two gabions (1, 1') which are, at least for part of each of them, stacked on top of each other in such a way that their respective intermediate compartments (C3, C3') of those gabions are laid out, at least in part, vertically above each other, and so that the mesh (11.1) at the bottom (11) of each gabion lets the granular acoustic insulation material pass through, so that this acoustic insulation material may join up in the respective intermediate compartments of the gabions continuously through the bottom set up between those intermediate compartments; and/or at least two gabions (1, 1") which are, at least for part of each of them, juxtaposed to each other by abutting one (14) of the side walls of the one of the gabions against one (15") of the side walls of the other gabion, in such a way that their respective intermediate compartments (C3, C3") in those gabions are laid out, at least in part, horizontally across from each other, and so that the mesh (14.1, 15.1) of the side walls (14, 15) of each gabion will allow the granular acoustic insulation material (2) to pass through, so that the granular acoustic insulation material joins up the respective intermediate compartments of the gabions continuously through the side walls and those intermediate compartments.

14. The noise barrier wall of claim 11, wherein the noise barrier wall further comprises at least one side plugging element (103) for the intermediate compartment (C3) of the gabion(s) (1), applied to an outer face of one (15) of the two side walls of that gabion so that the acoustic insulation material is stopped from crossing that side wall from the intermediate compartment.

15. The method of claim 10, wherein the at least one gabion is arranged to build at least one of a noise barrier wall or a firewall for civil engineering work, public works, or industrial or private facilities.

16. The gabion of claim 1, wherein the filler material comprises:

granules of natural calcium carbonate, that has undergone a surface reaction with carbon dioxide and one or more acids, with the carbon dioxide being formed in situ by the action of at least one of the acids and derived from an outside source.

17. The gabion of claim 16, wherein the acoustic insulation material comprises:

granules of natural calcium carbonate, that has undergone a surface reaction with carbon dioxide and one or more acids, the carbon dioxide being formed in situ by the action of at least one of the acids and from an outside source.

18. The gabion of claim 1, wherein the filler material comprises:

granules of precipitated calcium carbonate, that has undergone a surface reaction with carbon dioxide and one or more acids, with the carbon dioxide being formed in situ by the action of at least one of the acids and derived from an outside source.

19. The gabion of claim 18, wherein the acoustic insulation material comprises:

granules of precipitated calcium carbonate, that has undergone a surface reaction with carbon dioxide and one or more acids, the carbon dioxide being formed in situ by the action of at least one of the acids and from an outside source.

20. The gabion of claim 18, wherein the acoustic insulation material comprises:

granules of natural calcium carbonate, that has undergone a surface reaction with carbon dioxide and one or more acids, the carbon dioxide being formed in situ by the action of at least one of the acids and from an outside source.

* * * * *